US005613243A

United States Patent [19]

Hollitt et al.

[11] Patent Number: 5,613,243

[45] Date of Patent: Mar. 18, 1997

[54] STABILIZATION OF RADIONUCLIDES INTO WASTES

[75] Inventors: Michael J. Hollitt, Box Hill North; Ross A. McClelland, Maryknoll; Matthew J. Liddy, South Melbourne; Kaye P. Hart, Balgownie; Peter J. McGlinn, Thirroul, all of Australia

[73] Assignee: Technological Resources Pty. Ltd., Melbourne, Australia

[21] Appl. No.: 381,877

[22] PCT Filed: Aug. 13, 1993

[86] PCT No.: PCT/AU93/00413

§ 371 Date: Apr. 10, 1995

§ 102(e) Date: Apr. 10, 1995

[87] PCT Pub. No.: WO94/05015

PCT Pub. Date: Mar. 3, 1994

[30] Foreign Application Priority Data

Aug. 18, 1992 [AU] Australia ..... PL4141

[51] Int. Cl.[6] ..... G21F 9/00

[52] U.S. Cl. ..... 588/19; 588/15

[58] Field of Search ..... 588/19, 10, 11, 588/15; 110/237, 346; 501/152, 155

[56] References Cited

U.S. PATENT DOCUMENTS

| | | | |
|---|---|---|---|
| 4,224,177 | 9/1980 | Macedo et al. | 588/12 |
| 4,274,976 | 6/1981 | Kingwood | 588/15 |
| 4,314,909 | 2/1982 | Beall et al. | 588/11 |
| 4,329,248 | 5/1982 | Kingwood | 588/15 |
| 4,351,749 | 9/1982 | Kopp | 588/11 |
| 4,464,294 | 8/1984 | Thiele | 588/11 |
| 4,847,008 | 7/1989 | Boatner et al. | 588/11 |
| 4,891,164 | 1/1990 | Gaffney et al. | 588/19 |
| 5,364,568 | 11/1994 | Pope et al. | 588/18 |

*Primary Examiner*—Ngoclan Mai

*Attorney, Agent, or Firm*—Dennison, Meserole, Pollack & Scheiner

[57] ABSTRACT

The specification discloses a process for stabilizing radionuclides extracted during the upgrading of minerals. The process comprises forming a composition of a radionuclide and a component and roasting the composition so that the component forms a crystalline phase having a structure that binds the radionuclides. Suitable components include a compound of a lanthanide and/or phosphorus and zirconia. Zirconia in its cubic form is useful in stabilizing uranium and thorium.

13 Claims, No Drawings

STABILIZATION OF RADIONUCLIDES INTO WASTES

This invention relates to the stabilisation of radionuclides derived from naturally occurring materials into forms which are not accessible to the environment and are therefore suitable for disposal.

In a particular embodiment the present invention provides a process whereby a stable solid waste is formed by hydrolysis and roasting of aqueous solutions or suspensions containing radionuclides, particularly radionuclides in the decay chains of naturally occurring radioisotopes of uranium and thorium. In a general aspect the process of the invention comprises two basic steps for stabilising radionuclides present in a process stream, namely:

1. Ensuring the presence of a chemical composition and distribution in the stream, which upon roasting of the stream will be effective in stabilisation of radionuclides into crystalline phases such as to prevent significant immediate redistribution of radionuclides upon disposal into the environment.
2. Roasting of the stream in such a manner as to be effective in the formation of such phases.

Additional steps may be employed as will be described below.

Various processes for the treatment of ores, concentrates and processed materials have the effect of taking contained radionuclides into aqueous solution or rendering radionuclides sufficiently soluble to allow extraction by water in the environment. For example, the processing of uranium ores to yellowcake, the extraction of rare earths from monazite and processes for the production of upgraded products from mineral sands concentrates (for example ilmenite and zircon) result in the production of such materials.

In addition, various steps in the nuclear fuel cycle will have the effect of rendering both naturally occurring and synthetic radioisotopes accessible to environmental mobilisation. As a result, wastes from such processing must generally be stored in supervised and monitored repositories, despite the fact that the wastes are frequently of extremely low radioactivity.

A common problem in the conversion of radionuclide bearing wastes to stable forms is the multiplicity of radionuclides which are normally present. For example, the most common form of uranium, uranium 238 has 7 other elements in its decay chain which will all be present whenever uranium 238 is present. Similarly thorium 232 has 7 other elements in its decay chain. In order to prevent environmental mobility all of the multiplicity of radionuclides which are present in a waste stream must be simultaneously stabilised into environmentally inaccessible forms. In particular, uranium, thorium and radium must at least be stabilised. Few cost effective schemes to achieve such, outcomes exist. Those schemes which do exist commonly are suited to synthetic high level waste derived from nuclear reactors for which high cost waste disposal schemes can be contemplated. Further for these schemes there has been little effort or reported success with stabilisation of shorter lived decay progeny of uranium or thorium.

The only method for radium stabilisation which has previously been reported is coprecipitation, with sulphuric acid and barium chloride additions to form a radium bearing barium sulphate. This method requires large additions of expensive barium chemicals and is not fully effective. The solid wastes thus produced cannot be released safely into the environment as exposure to ground and surface water can result in solubilisation of contained radium.

The literature of radioactive waste forms (Harker, A. B., "Tailored Ceramics" in *Radioactive Wasteforms for the Future,* Lutze W. and Ewing R. C. eds., North Holland, 1988) lists the following crystalline ceramic phases as host phases for waste stabilisation:

| | |
|---|---|
| Actinide and rare earth hosts | |
| Flourite structure solid solutions | $UO_2$—$ThO_2$—$ZrO_2$ |
| Zirconolite | $CaZrTi_2O_7$ |
| Pyrochlores | $(Gd, La)_2\ Ti_2O_9$ |
| Perovskites | $CaTiO_3$ |
| Monazite | $(Gd, La)\ PO_4$ |
| Zircon | $ZrSiO_4$ |
| Strontium and alkaline earth hosts | |
| Magnetoplumbates | $(Ca, Sr)\ (Al, Fe)_{12}O_{19}$ |
| Perovskites | $(Ca, Sr)TiO_3$ |
| Hollandite | $Ba\ Al_2Ti_6O_{16}$ |
| Alkali Hosts | |
| Nepheline | $(Na, Cs)\ Al\ SiO_4$ |
| Perovskite | $(Gd, La)_{0.5}\ Na_{0.5}\ TiO_3$ |
| Magnetoplumbite | $(Na, Cs)_{0.5}\ La_{0.5}Al_{12}O_{19}$ |
| Hollandite | $(Ba_x\ Cs_y\ Na_2)\ Al_2Ti_6O_{16}$ |
| Non-fission product host phases | |
| Spinels | $(Mg, Ni, Fe)\ (Al, Fe, Cr)_2O_3$ |
| Corundum | $Al_2O_3$ |
| Rutile | $TiO_2$ |
| Pseudobrookite | $Fe_2TiO_5$ |

While other ceramic phases exist in various waste forms the other phases are usually minor phases of less importance to waste stabilization.

Methods for the formation of ceramic wastes typically involve sintering of ceramic precursors (possibly after preliminary drying and roasting) under high pressures (eg. 650 atmosphere) and at high temperatures (above 1000° C.) in order to produce ceramic monoliths of low surface area and therefore low reactivity. Nevertheless it has been demonstrated that such waste forms are accessible to environmental alteration, particularly in slightly acidic and in slightly basic aqueous solutions (as are frequently encountered in natural ground and surface water), and can deliver mobile radionuclides into the environment. The previously proposed methods are thus expensive and not fully effective.

There has previously been very little work aimed at stabilizing radionuclides into low level radioactive wastes. There exists a need for a low cost process for the stabilization of uranium and thorium and radionuclides in the decay chains of uranium and thorium into wastes containing from tens of parts per million to percents of uranium and thorium. Such stabilization must be effected as to prevent dissolution of the contained radionuclides from the wastes at a rate greater than that which can be absorbed and removed by environmental processes without accumulation to unacceptable levels significant to biological function.

Clearly there is considerable incentive to discover alternative methods for the stabilization of radionuclides into wastes which can be disposed of into the environment without significant risk of mobilisation, particularly for wastes derived in part from natural sources.

Accordingly the present invention provides a process for stabilization of radionuclides derived from naturally occurring sources, the process comprising the steps of:

(i) forming a composition of a radionuclide and sufficient of a stabilizing component to ensure that when the composition is roasted, a crystalline phase is formed having a structure that binds the radionuclide;

(ii) roasting the composition under conditions sufficient to form a crystalline phase in which the radionuclide is bound to reduce its environmental mobility.

The radionuclide bearing material may be in any form which is amenable to subsequent formation of the desired phases. It is particularly beneficial if the radionuclides are present in an aqueous solution to which the stabilizing component can be added in solution as an additive to provide excellent mixing. In such cases the aqueous solution may be evaporated prior to roasting if desired, and components in the solution may also be hydrolysed from salts to oxides, hydrated oxides and hydroxides prior to roasting. Alternatively solutions may be directly spray roasted, allowing evaporation, hydrolysis (pyrohydrolysis) and crystalline phase formation to occur simultaneously.

The roasted products of the process which is herein disclosed are of high surface area (1–100 $m^2$ per gram) and yet exhibit virtually no solubility of contained radionuclides. Expensive high pressure calcination may hence be avoided, demonstrating the superior performance of the waste form of the disclosed process by comparison with previously reported waste forms. Certainly it is not anticipated that it would be necessary to operate the process outside of normal chemical processing pressure ranges e.g. up to 20 atmospheres.

Additives (used in small proportions) for use as the stabilising component which have in particular been found to be beneficial in the process herein disclosed are lanthanide compounds and phosphorus compounds. Even a small addition of a lanthanide compound in the presence of phosphorus can result in highly effective stabilization of uranium and thorium. Stabilization of radium can be effect in the process. Any additives having the desired effect of stabilization of radionuclides into wastes and not interfering with the disclosed effects may be used. In some circumstances it will not be necessary to make additions to the stream to be treated by the process in order for the process to be effective.

The process as disclosed is not otherwise constrained. It may be conducted in any equipment and on any solution or other waste material which is capable of forming the desired phase combination. For most waste streams only small additions of additives will be required.

It is the combination of at least two elements (for example phosphorus and a lanthanide), under the conditions described which results in the complete effectiveness of the presently disclosed scheme in stabilizing the full range of important radionuclides. No other ceramic waste form which specifically stabilizes by chemical means uranium, thorium and all decay progeny simultaneously has previously been disclosed. A lanthanide that has been found to be particularly useful is cerium.

The following examples further illustrate the invention.

EXAMPLES

Chloride solutions having the compositions indicated in the attached Table 1 were first evaporated to dryness at 80° C. to produce solid residues. These residues were then held under a flow of steam at 200° C. for one hour and then under a flow of steam and air at 800° C. for two hours, ensuring both the completion of all possible hydrolysis and the development of crystalline properties. The granular solid residues were then allowed to cool in air.

The solid wastes were then leached at room temperature (62.5 gpL) in synthetic groundwater (5 gpL sodium chloride, 500 mgpL sulphuric acid) maintained at pH below 5 by periodic additions of acetic acid. The leach was continued for 24 hours, after which the residue was filtered, washed with fresh synthetic groundwater and dried.

Roasted and leached wastes were subjected to chemical analysis and gamma spectroscopy analysis for major elements and radionuclides. Radionuclide extraction from the solid wastes in leaching is also indicated for each case in the attached Table 1.

Clearly those samples having lanthanide (eg. Ce) and P additions under circumstances which produced a waste needing little or no acid addition to maintain pH below 5 provided wastes which did not subsequently allow leaching of radionuclides. The absence of these elements or conditions resulted in a far less stable waste. However, it is expected that other elements may substitute for these main constituents, allowing for a range of effective compositions, provided that the effective circumstances as disclosed are maintained.

Further, the addition of barium salts (made to liquor A1-9 of the attached table in a separate test) was found to have a strongly negative impact on the stability of uranium and radium in the wastes produced by otherwise identical treatment. Hence wastes containing barium, lanthanide and phosphorus (as have previously been produced in waste forms, due to the composition of wastes from nuclear fuel processing which contain zirconium and phosphorus) are herein disclosed as ineffective for the purposes for which the present invention is practised. In general where the effectiveness of the process depends on the presence of phosphorus and lanthanides the presence of elements which form more stable phosphates than lanthanides may require the addition of incremental compensating phosphorus for all other identical conditions.

Solutions derived from the production of synthetic rutile by acid leaching of thermally treated ilmenite to which additives were made to result in solutions having the composition indicated in the attached Table 2 were also treated according to the method described above.

Roasted and leached wastes were subjected to chemical analysis and gamma spectroscopy analysis for major elements and radionuclides. Radionuclide extraction from the solid wastes in leaching is also indicated for each case in the attached Table 2.

TABLE 1

Liquor Compositions and Waste Stability, Illustrating the Process Disclosed.

| | A1-6 | A1-9 | A2-1 | A2-2 | A2-3 | A2-4 | A3-1 | A3-2 | A3-4 | A3-5 | A1-2 |
|---|---|---|---|---|---|---|---|---|---|---|---|
| | | | | Liquor, g/L | | | | | | | |
| Fe | 0.25 | 23.2 | 0.27 | 0.27 | 0.27 | 0.27 | 0.27 | 0.27 | 58.1 | 0.27 | 36.8 |
| Zr | 2.01 | 2.01 | 1.98 | 1.98 | 1.98 | 1.98 | 1.98 | 1.98 | — | 1.98 | 0.73 |
| Si | 0.058 | 0.058 | 0.29 | 0.29 | 0.29 | 0.29 | 0.29 | 0.29 | — | 0.29 | — |
| Ti | 0.064 | 0.064 | 0.064 | 0.064 | 0.064 | 0.064 | 0.064 | 0.064 | — | 0.064 | — |
| Y | 0.172 | 0.172 | — | 0.172 | — | 0.172 | 0.172 | 0.172 | 0.172 | 0.172 | — |
| Mg | 0.169 | 0.169 | — | — | 0.169 | 0.169 | 0.169 | 0.169 | — | 0.169 | — |
| Al | 0.43 | 0.43 | 0.43 | — | — | 0.43 | 0.43 | 0.43 | — | 0.43 | — |
| P | <0.020 | <0.020 | — | — | — | — | 0.09 | 0.09 | 0.09 | 0.135 | — |
| Ca | 6.50 | 6.50 | 6.50 | 6.50 | 6.50 | 6.50 | 6.50 | 6.50 | — | 6.50 | 4.69 |
| Ce | 0.01 | 0.01 | — | — | — | — | — | 0.011 | — | 0.011 | — |
| Hf | 0.062 | 0.062 | 0.062 | 0.062 | 0.062 | 0.062 | 0.062 | 0.062 | — | 0.062 | — |
| Cl | 71.0 | 114.7 | 71.0 | 71.0 | 71.0 | 71.0 | 71.0 | 71.0 | 110.7 | 71.0 | 78.5 |
| Na | — | — | 0.42 | 0.42 | 0.42 | 0.42 | 0.42 | 0.42 | — | 0.42 | — |
| U −238 | 0.028 | 0.028 | 0.029 | 0.029 | 0.029 | 0.029 | 0.029 | 0.029 | 0.029 | 0.029 | 0.5 |
| Th −232 | 0.070 | 0.070 | 0.070 | 0.070 | 0.070 | 0.070 | 0.070 | 0.070 | 0.070 | 0.070 | 0.5 |
| Ra −226 | 400 | 400 | 400 | 400 | 400 | 400 | 400 | 400 | 400 | 400 | 6000 |
| $H_2SO_4$ Addition (g/l) | 14.2 | 14.2 | 15.7 | 15.7 | 15.7 | 15.7 | 15.7 | 15.7 | 15.7 | 15.7 | 10.9 |
| | | | | Waste Leach Results | | | | | | | |
| Acetic Acid Addition 0.5.M mL/L | 0 | 0 | 47.6 | 33.2 | 41.4 | 46 | 3.9 | 48.4 | 0 | 0 | 0 |
| U Extraction % | 0 | 6.2 | 8.0 | 3.6 | 8.6 | 6.5 | 13.0 | 0 | 13.3 | 0 | 69 |
| Th Extraction % | 0 | 3.6 | 6.1 | 0 | 3.8 | 0 | 16.0 | 0 | 14.6 | 0 | 0 |
| Ra Extraction % | 0–10 | 21 | 18 | 34 | 71 | 44 | 0 | 28 | 11 | 15 | 44 |

TABLE 2

Liquor Compositions and Waste Stability

| | A4-1 | A4-2 | A4-3 |
|---|---|---|---|
| | Liquor, g/L | | |
| Fe | 84.4 | 86.9 | 83.8 |
| Zr | 0.009 | 5.15 | 5.12 |
| Si | 0.023 | 0.028 | 0.028 |
| Ti | 0.177 | 0.171 | 0.150 |
| Y | 0.011 | 0.012 | 0.012 |
| Mg | 2.29 | 2.41 | 2.10 |
| Al | 0.146 | 0.175 | 2.70 |
| P | 0.097 | 1.38 | 2.65 |
| Ca | 0.110 | 0.115 | 0.116 |
| Ce | 0.048 | 0.158 | 0.168 |
| Hf | — | — | — |
| Cl | n.d. | n.d. | n.d. |
| Na | 0.515 | 0.555 | 0.546 |
| U −238 | 0.180 | 0.182 | 0.158 |
| Th −232 | 0.102 | 0.106 | 0.090 |
| Ra −226* | | | |
| $H_2SO_4$ Addition (g/l) | 0 | 0 | 0 |
| | Waste Leach Results | | |
| Acetic Acid Addition 0.5 .M mL/L | 0 | 5.2 | 5.0 |
| U Extraction % | 19.8 | 0.13 | 0.08 |
| Th Extraction % | 0.11 | 0 | 0 |
| Ra Extraction % | 3 | 7 | 4 |

n.d. = not determined
*in radiochemical equilibrium with uranium

What is claimed is:

1. A process for stabilization of radionuclides derived from naturally occurring mineral sources, the process comprising the steps of:

(i) forming a substantially barium-free composition comprising a radionuclide and sufficient stabilizing component to ensure that when the composition is roasted, a crystalline phase is formed having a structure that binds the radionuclide; and (ii) roasting the composition under conditions sufficient to form said crystalline phase as a granular solid of surface area 1–100 $m^2/g$ in which the radionuclide is bound such that there is substantially no solubility of the radionuclide.

2. A process according to claim 1, wherein the stabilizing component is a compound of a lanthanide and/or a compound of phosphorus.

3. A process according to claim 2, wherein the stabilizing component is a compound of a lanthanide and a compound of phosphorus.

4. A process according to claim 2 or claim 3, wherein the radionuclide includes uranium and/or thorium and/or progeny radionuclides in the decay chains of thorium and uranium radioisotopes.

5. A process according to claim 2 or claim 3, wherein the radionuclide includes radium.

6. A process according to claim 1, wherein the stabilizing component is a zirconium compound that is capable of producing a zirconia phase when roasted.

7. A process according to claim 6, wherein the stabilizing component includes an element that promotes the formation of a cubic form of zirconia.

8. A process according to claim 6 or claim 7, wherein the radionuclides include uranium and thorium.

9. A process according to claim 1, wherein the composition comprises an aqueous solution of the radionuclide and the stabilizing component.

10. A process according to claim 9, further comprising the step of evaporating the solution prior to said roasting the composition.

11. A process according to claim 1, wherein roasting is conducted at a pressure no greater than 20 atmospheres.

12. A process according to claim 1, wherein said roasting is spray roasting.

13. A process according to claim 9, wherein said solution undergoes hydrolysis of salts therein to oxides, hydrated oxides, hydroxides or mixtures thereof prior to said roasting.

* * * * *